United States Patent [19]

Moore

[11] Patent Number: 4,905,924

[45] Date of Patent: Mar. 6, 1990

[54] WEB SPLICING TAPE

[75] Inventor: Chester W. Moore, Rockford, Ill.

[73] Assignee: Enkel Corporation, Rockford, Ill.

[21] Appl. No.: 377,157

[22] Filed: Jul. 10, 1989

[51] Int. Cl.[4] ..... B31F 5/06; B65H 21/00

[52] U.S. Cl. ..... 242/58.5; 156/504

[58] Field of Search ..... 242/58.5, 58.3; 156/157, 502, 504, 506, 508

[56] References Cited

U.S. PATENT DOCUMENTS

| | | | |
|---|---|---|---|
| 2,149,832 | 3/1939 | Bernard | 242/58.5 |
| 2,149,833 | 3/1939 | Bernard | 242/58.5 |
| 2,212,937 | 8/1940 | Morton | 242/58.5 |
| 2,377,971 | 6/1945 | Roesen | 242/58.5 |
| 2,812,145 | 11/1957 | Meloche | 242/58.5 |
| 3,001,735 | 9/1961 | Francik | 242/58.5 |

*Primary Examiner*—Stuart S. Levy
*Assistant Examiner*—Steven M. duBois
*Attorney, Agent, or Firm*—Leydig, Voit & Mayer

[57] ABSTRACT

A tape for splicing the leading end portion of a standby roll of web to the trailing end portion of an active web. The tape includes first and second longitudinally extending sections which are secured to the outer layer and adjacent inner layer, respectively, of the standby roll by adhesive. A longitudinally extending intermediate section which is free of adhesive joins the first and second sections to one another and causes those two sections to coact to hold the outer layer to the adjacent layer during rotation of the standby roll prior to splicing while permitting the outer layer to lift away from the adjacent layer as the splice is made. Longitudinally extending and parallel score lines are formed through the first section but not through the adhesive thereof. The score lines enable two spaced bands of the first section to be peeled away to expose two spaced adhesive stripes for making the splice and to leave an intervening bridge for protecting the stripes against contact with equipment or the like.

3 Claims, 2 Drawing Sheets

WEB SPLICING TAPE

BACKGROUND OF THE INVENTION

This invention relates generally to web splicing and, more particularly, to the splicing of the leading end portion of a fresh roll of web to the trailing end portion of a running web traveling through a continuous web processing line such as a printing press or the like. The invention is applicable both to systems in which the splice is made on the fly and to systems in which the splice is made while the running web is stationary.

A web processing system with a flying splicer is disclosed in Keene et al U.S. Pat. No. 4,564,150. In the system disclosed in that patent, the free end of the web of the fresh roll is cut into a V shape and a V-shaped band of adhesive is applied to the free end portion of the web. An adhesive tab also is applied to the free end portion of the web at the apex of the V and secures the outer layer of the roll to the adjacent inner layer. The tab holds the outer layer against the inner layer while the roll is being rotated preparatory to splicing and then tears away as the splice is made.

A system of the type disclosed in the Keene et al patent has two significant drawbacks. First, most of the free edge of the web of the fresh roll is exposed and thus windage which occurs during high speed rotation of the roll tends to unwind the web from the roll and may tear the web. The problem of windage is accentuated by the fact that the exposed leading edge of the roll is V-shaped and thus is relatively long and susceptible to lifting.

The second drawback involves the time required by an operator to place an adhesive splicing pattern on the leading end portion of each roll. Typically, the pattern is applied at the splicing station itself, thereby requiring an operator at each machine.

SUMMARY OF THE INVENTION

The general aim of the present invention is to provide a new and improved splicing tape which may be quickly and easily pre-applied to the roll at a location remote from the splicing station and which covers the entire leading edge of the roll so as to reduce the likelihood of the web unwinding or tearing due to windage.

A more detailed object of the invention is to provide an easily applied splicing tape having uniquely located areas of adhesive for holding the outer layer of a roll of web against the adjacent layer along the entire leading edge of the web and for enabling the leading end portion of the web to be effectively spliced to the trailing portion of another web.

The invention also resides in the novel construction of the tape for preventing the adhesive areas from being fouled by roll driving and handling equipment or the like.

These and other objects and advantages of the invention will become more apparent from the following detailed description when taken in conjunction with the accompanying drawings.

DETAILED DESCRIPTION OF THE PREFERRED EMBODIMENT

Figure 5:
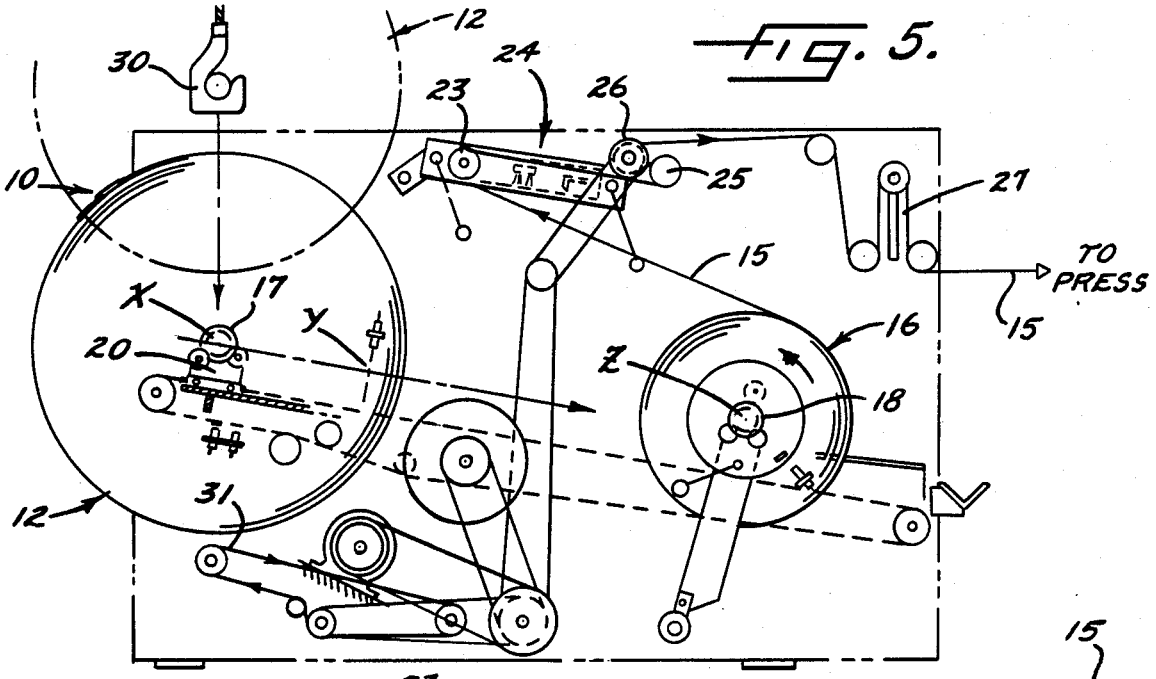
FIG. 5 is an elevational view schematically showing equipment for making the splice.

For purposes of illustration, the invention has been shown in the drawings in conjunction with a tape 10 for initially holding down the leading end portion of the outer layer 11 of a roll 12 of web 13 such as paper or the like against the adjacent inner layer 14 of the roll and for subsequently enabling such leading end portion to be spliced to the trailing end portion of a preceding web 15 drawn from a roll 16 (FIG. 5). The splice tape 10 has been specifically shown and will be specifically described in connection with a web handling system of the same general type as disclosed in Keene et al U.S. Pat. No. 4,564,150.

In such a system, the webs 13 and 15 are wound around cores 17 and 18 (FIG. 5), respectively, which support the rolls for rotation about their own axes. The web 15 is drawn off of the active roll 16 by a printing press or the like and the web 13 of the standby roll 12 is spliced to the web 15 just before the web of the active roll is exhausted. The standby roll then becomes the active roll and a new standby roll is loaded into the system.

Figure 6:
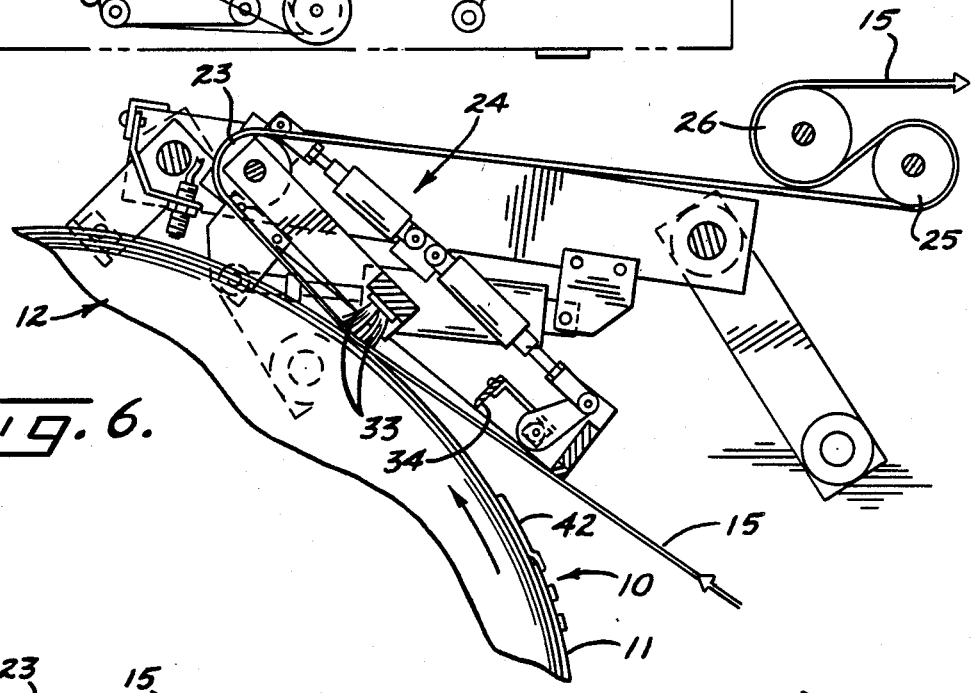
FIG. 6 is an enlarged fragmentary side elevational view showing the equipment of FIG. 5 making the splice.
Figure 7:
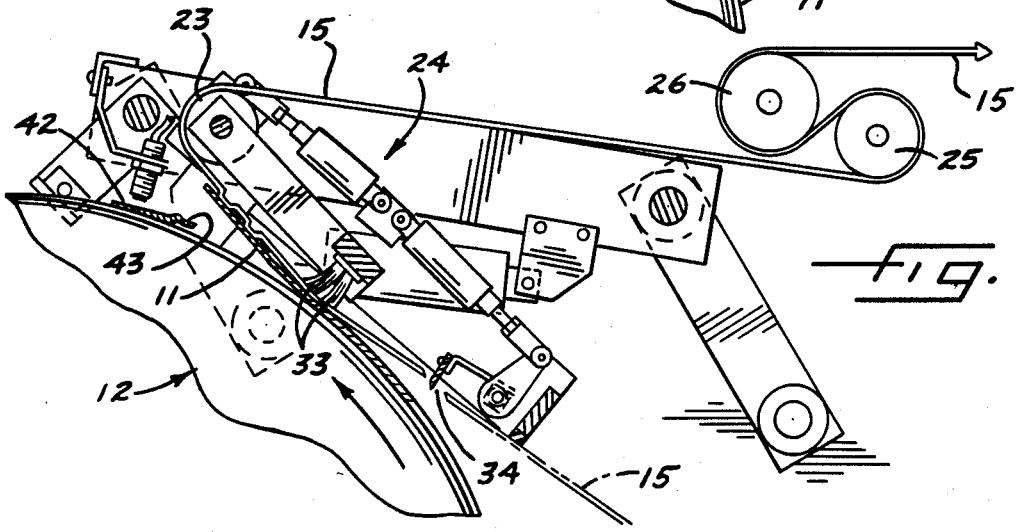
FIG. 7 is a view similar to FIG. 6 but shows the equipment just after the splice has been made.

As disclosed in the aforementioned patent, a new roll 12 is loaded onto a carrier 20 (FIG. 5) which is supported to advance the roll from a loading station X to a splicing station Y and then to a running station Z. The web 15 from the active roll 16 at the running station is trained around a roller 23 (FIGS. 5 to 7) of a splicing mechanism 24, around idler rollers 25 and 26 and around a web tensioning dancer 27 before proceeding to the printing press.

Figure 1:
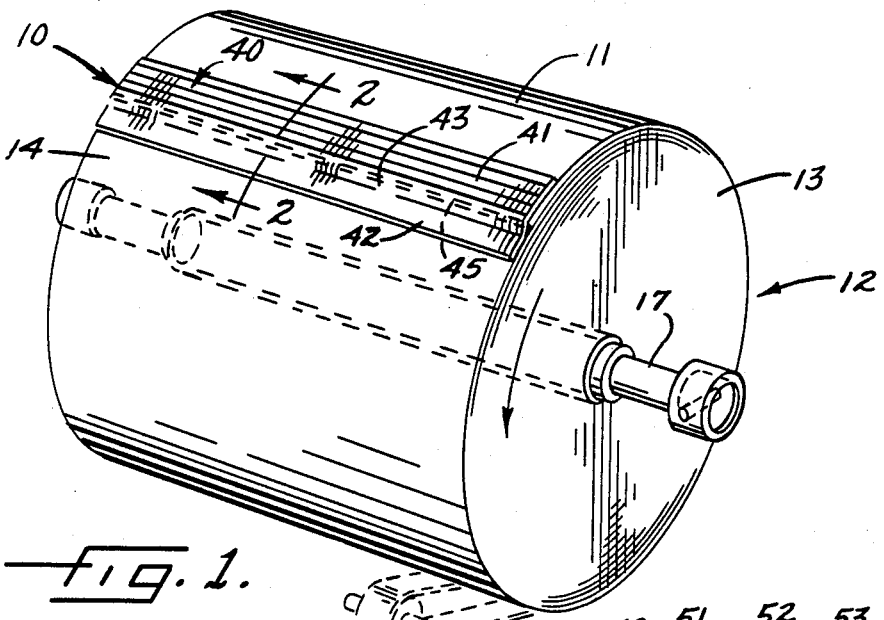
FIG. 1 is a perspective view of a typical roll of web equipped with a new and improved splice tape incorporating the unique features of the present invention.

While the web 15 is being drawn from an active roll 16, a new standby roll 12 is lowered onto the carrier 20 as by means of the hook 30 of a crane (FIG. 5) so that this roll is disposed at the station X. Subsequently, the standby roll is advanced by the carrier to the splicing station Y and, when the active roll is nearly exhausted, the splicing of the running web 15 to the web 13 on the standby roll 12 is initiated. Thus an accelerator belt 31 (FIG. 1) at the station Y frictionally engages the periphery of the standby roll to turn the latter about the axis of its core 17. When the standby roll has been fully accelerated, the operation of the splicing mechanism 24 is effected, that is, a brush 33 produces an adhesive seal between the webs 13 and 15 and then a knife 34 severs the exhausting active roll 16 from the combined web. As a result, the web from the standby roll 12 at the station Y is supplied to the press.

The splice tape 10 is used to produce an adhesive seal between the leading end portion of the web 13 of the standby roll 12 and the trailing end portion of the web 15 of the active roll 16. In accordance with the present invention, the splice tape 10 is uniquely constructed so as to enable the tape to be applied quickly and easily to the roll 12, extends along the entire length of the roll 12 so as to hold the outer layer 11 against the adjacent inner layer 14 and prevent the web 13 from unwinding during high speed rotation of the roll prior to splicing, and allows the outer layer 11 of the roll to separate cleanly from the adjacent inner layer 14 when the splice is made.

The present splice tape 10 is formed in part by an elongated strip 40 of release paper which may be a 0.007" to 0.009" thick commercially available paper which is coated on both sides with silicone so as to provide good release characteristics with respect to an adhesive to be described subsequently. The strip 40 is sufficiently long to extend along the entire length of the roll 12 as is shown most clearly in FIG. 1.

In carrying out the invention, the strip 40 includes a first longitudinally extending section 41 (FIG. 2), a second longitudinally extending section 42, and an intermediate longitudinally extending section 43 which is located between the first and second sections. As shown most clearly in FIG. 2, the first section 41 of the strip 40 overlies the leading end portion of the outer layer 11 of the roll 12. Its inner side is coated with a pressure-sensitive adhesive 44 similar in construction and chemical make up to the adhesive of 3M No. 906 repulpable flying splice tape. In this instance, the leading edge of the adhesive 44 terminates just short of the free edge 45 of the outer layer 11 although the adhesive could extend to the free edge 45. For purposes of further discussion, the first section 41 of the strip 40 is considered to coincide with that portion of the strip that is coated with the adhesive 44.

The second section 42 of the strip 40 is spaced from the first section 41 in the direction of rotation of the roll 12 and overlies the adjacent inner layer 14 of the roll 12. A coating of pressure-sensitive adhesive 46 (FIG. 2) is on the inner side of the second section 42 of the strip 40 and secures the second section to the inner layer 14. The adhesive 46 is the same type as the adhesive 45.

The intermediate section 43 is located between the first and second sections 41 and 42 and extends across the junction between the outer and inner layers 11 and 14. Importantly, the inner side of the intermediate section 43 is free of adhesive and thus the intermediate section is not connected directly to either the outer layer 11 or the inner layer 14. The intermediate section 43 is, however, integrally joined to the first and second sections 41 and 42 and thus serves to connect the first section to the second section. By virtue of the first and second sections 41 and 42 being secured to the outer and inner layers 11 and 14, respectively, by the adhesive 45 and 46 and by virtue of those two sections being joined to one another by the intermediate section 43, the tape 10 serves to hold the outer layer against the inner layer. Because the tape 10 extends along the entire length of the roll 12, the leading edge portion of the outer layer 11 is held down along its full length. This prevents the outer layer from being unwound by centrifugal force and windage when the roll 12 is rotated at high speed by the accelerator belt 31 during the splicing operation. As a result, the splicing operation can be carried out in a trouble-free manner and without danger of the leading edge portion of the web 13 becoming torn as sometimes occurs when only a short length of the leading edge portion is held down and the remainder of the leading edge portion is buffeted by air.

Further in keeping with the invention, the first section 41 of the tape 10 is uniquely constructed to provide an effective and trouble-free adhesive surface for making the splice. For this purpose, several (herein, four) longitudinally extending and parallel score lines 51, 52, 53 and 54 (FIG. 2) are formed through the first section 41. Each score line is cut through the release paper or liner of the first section 41 but does not extend through the adhesive 44 underlying the first section. By virtue of the score lines, the first section 41 is divided into four lengths or bands A, B, C and D (FIG. 2) which herein are all of equal dimension in the circumferential direction. The band A is located circumferentially such that its leading end is just short of the leading end of the adhesive 44. The trailing end of the band D coincides with the trailing end of the adhesive 44.

Figure 2:
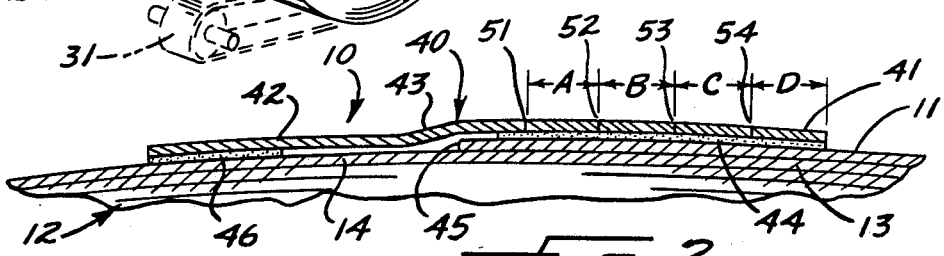
FIG. 2 is an enlarged fragmentary cross-section taken along the line 2—2 of FIG. 1.

With the foregoing arrangement, the tape 10 is applied to the roll 12 at any convenient time and at any convenient place by pressing the first section 41 of the strip 40 onto the outer layer 11 and by pressing the second section 42 of the strip onto the inner layer 14 (see FIG. 2). At the time the tape 10 is applied to the roll 12, all four bands A, B, C and D are intact and protect the outer side of the adhesive 44 against contamination.

Before the roll 12 is shifted to the splicing station Y, the bands A and C are peeled away from the adhesive 44, the score lines 51 and 52 permitting the band A to be peeled away and the score lines 53 and 54 enabling the band C to be peeled away. If desired, the bands may be peeled away before the roll 12 is picked up by the hook 30 or may be peeled away after the roll has been placed on the carriage 20 by the hook.

Figure 3:
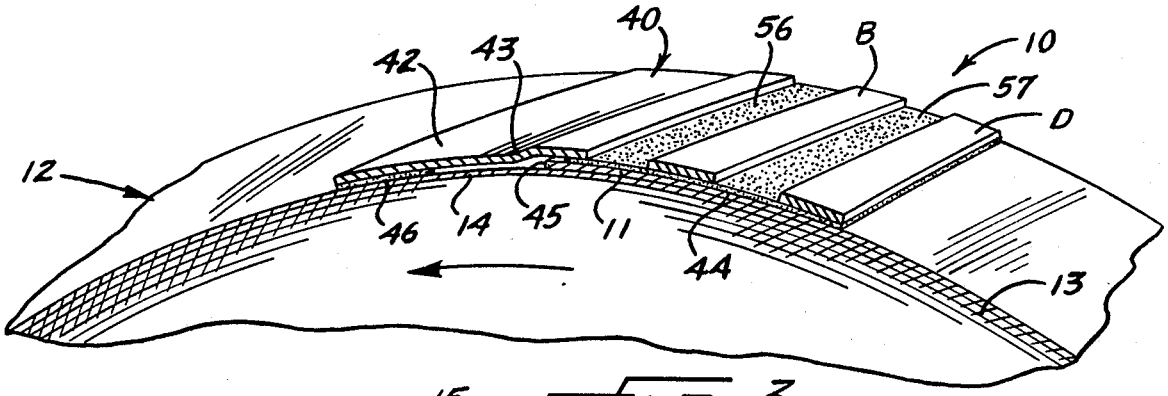
FIG. 3 is an enlarged perspective view showing the splice tape and the roll just prior to the splice being made.

As a result of peeling away the bands A and C, two longitudinally extending pressure-sensitive adhesive stripes 56 and 57 (FIG. 3) are exposed on the outer side of the tape 10. These adhesive stripes subsequently are used to make the splice. Before the splice is made, however, the band B, which remains intact, serves as a protective bridge between the adhesive stripes 56 and 57 and prevents the stripes from making contact with other articles and becoming contaminated. For example, the raised band B coacts with the band D and with the leading end portion of the section 41 to prevent the adhesive stripes 56 and 57 from contacting the floor, the lift fork of a lifting truck and any other roll handling equipment. Also, the bands B and D prevent the accelerator belt 31 from contacting the adhesive stripes 56 and 57 when the belt rotates the roll 12 prior to the splice being made.

Figure 4:
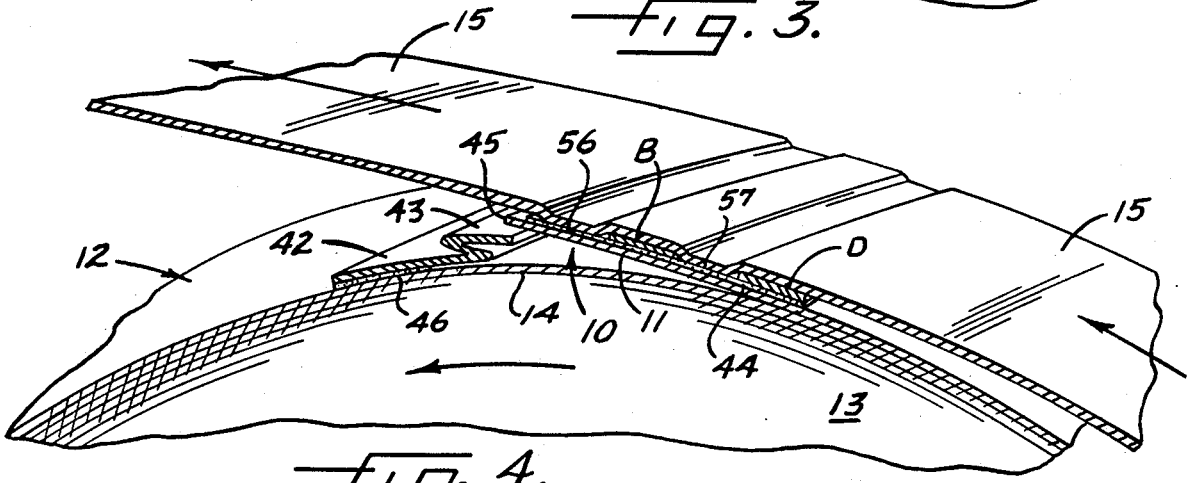
FIG. 4 is a view similar to FIG. 3 but shows the splice tape and the roll just after the splice has been made.

Once the bands A and C have been peeled away, the web 13 is ready to be spliced to the web 15. To effect such splicing, the brush 33 (FIG. 6) is swung downwardly in the manner disclosed in the aforementioned patent and presses the running web 15 against the web 13 on the standby roll 12, the latter being rotated by the belt 31. As the exposed adhesive stripes 56 and 57 pass beneath the brush, the running web 15 is pressed downwardly against the stripes by the brush to cause the two webs to adhere to one another. At this time, the running web 15 lifts the leading end portion of the outer layer 11 of the roll 12 and, as an incident thereto, the second section 42, the intermediate section 43 and a very small portion of the first section 41 tear away from the remaining portion of the first section along the score line 51 (see FIG. 4). Such lifting and tearing is permitted by the fact that the intermediate section 43 is free of adhesive and thus does not directly secure the outer layer 11 to the inner layer 14. As a result of such tearing, the major portion of the first section 41 becomes free to travel with the web 15 and the outer layer 11 of the web 13 while the remainder of the tape 10 remains attached to the inner layer 14 of the web 13 and turns with the roll 12 (see FIG. 7). Shortly after the splice is made, the knife 34 is actuated to cut the running web 15 from the roll 16 and, at this time, the web 13 becomes the new running web.

The tape 10 may be supplied as individual "patches" which are applied to individual rolls 16. Preferably, however, the tape is supplied in a roll with preformed patterns of adhesive 44 and 46 and with preformed score lines 51 to 54 being in place in repeating lengths of the tape. Thus, an individual tape 10 may be obtained by cutting an appropriate length from the roll.

While the tape 10 of the invention has been specifically disclosed in connection with a flying splice system, it will be appreciated that the tape also may be used in a zero speed system in which the splice is made while the active web is stationary. In such a case, it is necessary only to apply the tape to the new roll, to peel away the bands A and C and to press the active web against the adhesive stripes 56 and 57. The operator thus is relieved from the time consuming task of applying an adhesive pattern to the roll 16 at the splicing station. In addition, the preformed tapes provide uniformity of splicing from roll-to-roll.

I claim:

1. A tape for holding down the leading end portion of the outer layer of a roll of web and for enabling the leading end portion to be spliced to the trailing end portion of an active web, said tape comprising an elongated strip of release material having inner and outer sides, said strip having a first longitudinally extending section, having a second longitudinally extending section, and having an intermediate longitudinally extending section located between said first and second sections, first adhesive on the inner side of said first section, second adhesive on the inner side of said second section, the inner side of said intermediate section being free of adhesive, first, second, third and fourth longitudinal and substantially parallel score lines extending through said first section of said strip but not through the first adhesive on the inner side of said first section, a first length of said first section of said strip being adapted to be peeled away from said first adhesive between said first and second score lines so as to leave a first stripe of adhesive exposed from the outer side of said strip, a second length of said first section of said strip being adapted to be peeled away from said first adhesive between said third and fourth score lines so as to leave a second stripe of adhesive exposed from the outer side of said strip, and a third length of said strip located between said second and third score lines remaining intact and serving as a bridge to protect said first and second adhesive stripes.

2. A tape for enabling the leading end portion of a roll of web to be spliced to the trailing end portion of an active web, said tape comprising an elongated strip of release material having inner and outer sides and having approximately the same length as the roll, said strip extending longitudinally of the roll and having a first longitudinally extending section overlying the leading end portion of the outer layer of the roll, having a second longitudinally extending section overlying the adjacent layer of the roll, and having a longitudinally extending intermediate section located between said first and second sections and overlying the junction between said outer layer and said adjacent layer, first adhesive on the inner side of said first section of said strip for securing said first section to the leading end portion of said outer layer, second adhesive on the inner side of said second section of said strip for securing said second section to said adjacent layer whereby sad strip acts to hold the leading end portion of said outer layer against said adjacent layer, the inner side of said intermediate section of said strip being free of adhesive, first, second, third and fourth longitudinal and substantially parallel score lines extending through said first section of said strip but not through the first adhesive on the inner side of said first section, a first length of said first section of said strip being adapted to be peeled away from said first adhesive between said first and second score lines so as to leave a first stripe of adhesive exposed on said outer layer, a second length of said first section of said strip being adapted to be peeled away from said first adhesive between said third and fourth score lines so as to leave a second stripe of adhesive exposed on said outer layer, a third length of said strip located between said second and third score lines remaining intact and serving as a bridge to protect said first and second adhesive stripes, said active web adhering to said first and second adhesive stripes after said first and second lengths of strip have been peeled away and when said active web is placed in contact with said stripes, and said first section being adapted to be torn away from said intermediate section to free said outer layer to travel with said active web.

3. The combination of, a roll of web having an outer layer with a leading end portion and having an adjacent layer, and a tape for securing the leading end portion of said outer layer to said adjacent layer and for enabling said leading end portion to be spliced to the trailing end portion of an active web, said tape comprising an elongated strip of release material having inner and outer sides and having approximately the same length as the roll, said strip extending longitudinally of the roll and having a first longitudinally extending section overlying the leading end portion of the outer layer of the roll, having a second longitudinally extending section overlying the adjacent layer of the roll, and having a longitudinally extending intermediate section located between said first and second sections and overlying the junction between said outer layer and said adjacent layer, first adhesive on the inner side of said first section of said strip for securing said first section to the leading end portion of said outer layer, second adhesive on the inner side of said second section of said strip for securing said second section to said adjacent layer whereby said strip acts to hold the leading end portion of said outer layer against said adjacent layer, the inner side of said intermediate section of said strip being free of adhesive, first, second, third and fourth longitudinal and substantially parallel score lines extending through said first section of said strip but not through the first adhesive on the inner side of said first section, a first length of said first section of said strip being adapted to be peeled away from said first adhesive between said first and second score lines so as to leave a first stripe of adhesive exposed on said outer layer, a second length of said first section of said strip being adapted to be peeled away from said first adhesive between said third and fourth score lines so as to leave a second stripe of adhesive exposed on said outer layer, a third length of said strip located between said second and third score lines remaining intact and serving as a bridge to protect said first and second adhesive stripes, said active web adhering to said first and second adhesive stripes after said first and second lengths of strip have been peeled away and when said active web is placed in contact with said stripes, and said first section being adapted to be torn away from said intermediate section to free said outer layer to travel with said active web.

* * * * *